US010078932B2

(12) United States Patent
Lee et al.

(10) Patent No.: US 10,078,932 B2
(45) Date of Patent: Sep. 18, 2018

(54) REMOTE CONTROL DEVICE, VEHICLE, AND METHOD FOR CONTROLLING THE VEHICLE

(71) Applicant: Hyundai Motor Company, Seoul (KR)

(72) Inventors: Jihye Lee, Sokcho-si (KR); Jongyoung Lee, Seongnam-si (KR); Sinjung Kim, Bucheon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 15/593,825

(22) Filed: May 12, 2017

(65) Prior Publication Data

US 2018/0174387 A1 Jun. 21, 2018

(30) Foreign Application Priority Data

Dec. 19, 2016 (KR) ..... 10-2016-0173733

(51) Int. Cl.
*G07C 9/00* (2006.01)

(52) U.S. Cl.
CPC ..... *G07C 9/00309* (2013.01); *G07C 2009/00436* (2013.01); *G07C 2009/00555* (2013.01); *G07C 2009/00984* (2013.01)

(58) Field of Classification Search
CPC ..... G07C 9/00309; G07C 2009/00793; G07C 2209/63; B60R 25/24; B60R 25/04
USPC ..... 340/5.72, 5.1, 5.2, 5.7, 5.71, 5.74
See application file for complete search history.

(56) References Cited

U.S. PATENT DOCUMENTS

| | | | | |
|---|---|---|---|---|
| 4,430,652 | A * | 2/1984 | Rothenbuhler | G08C 19/28 212/285 |
| 7,295,849 | B2 | 11/2007 | Ghabra et al. | |
| 8,193,915 | B2 | 6/2012 | McCall et al. | |
| 2008/0178015 | A1* | 7/2008 | Sago | B60W 50/0205 713/300 |
| 2017/0190316 | A1* | 7/2017 | Kim | B60R 25/24 |
| 2017/0372537 | A1* | 12/2017 | Zielinski | G07C 9/00023 |

FOREIGN PATENT DOCUMENTS

| | | |
|---|---|---|
| JP | 2010-016606 | 1/2010 |
| KR | 10-1362848 | 2/2014 |

* cited by examiner

*Primary Examiner* — Yong Hang Jiang
(74) *Attorney, Agent, or Firm* — Brinks Gilson & Lione

(57) ABSTRACT

A vehicle includes: a timer measuring a time; a receiver receiving data from a remote control device; a storage storing a unique value of a vehicle, a timer count value of the vehicle, and a timer difference value between the remote control device and the vehicle; and a controller increasing the timer count value of the vehicle after lapse of a predetermined time. In particular, the controller compares a unique value of the remote control device contained in the data with the unique value of the vehicle stored in the storage, and determines whether a user command contained in the data is approved based on a result of the comparison.

20 Claims, 7 Drawing Sheets

FIG. 5

230

STORAGE OF REMOTE CONTROL DEVICE

| CATEGORIES | VALUES |
|---|---|
| FIRST TIMER COUNT VALUE | $V_{FC1}$ |
| SECOND TIMER COUNT VALUE | $V_{FC2}$ |
| MAXIMUM VALUE OF SECOND TIMER COUNT VALUE | $V_{MAX}$ |
| UNIQUE VALUE | $V_{FSYNC}$ |

130

STORAGE OF VEHICLE

| CATEGORIES | VALUES |
|---|---|
| TIMER DIFFERENCE VALUE OF VEHICLE | $V_{CC1}$ |
| TIMER DIFFERENCE VALUE | $V_{\Delta C}$ |
| UNIQUE VALUE | $V_{CSYNC}$ |

<REMOTE CONTROL DEVICE>

<VEHICLE >

REMOTE CONTROL DEVICE, VEHICLE, AND METHOD FOR CONTROLLING THE VEHICLE

CROSS-REFERENCE TO RELATED APPLICATION

This application claims priority to and the benefit of Korean Patent Application No. 10-2016-0173733, filed on Dec. 19, 2016, which is incorporated herein by reference in its entirety.

FIELD

The present disclosure relates to a remote control device, a vehicle for receiving data from the remote control device, and a method for controlling the vehicle.

BACKGROUND

The statements in this section merely provide background information related to the present disclosure and may not constitute prior art.

A remote control device for a vehicle allows a driver who is located outside the vehicle to open or close doors of the vehicle as well as to start the vehicle, although the driver does not insert an ignition key into a key box of the vehicle or does not perform special manipulation for vehicle operation. Generally, a smart card capable of being easily carried by the driver and a fob for wireless communication have been widely used for the remote control device.

If the driver who carries the remote control device approaches the vehicle, door lock is automatically released through Low Frequency (LF) and Radio Frequency (RF) communication with the remote control device, such that the driver can easily open the doors without inserting a key into a keyhole of the door and can start the vehicle without insertion of the ignition key.

We have discovered that data hacking problems have occurred in the remote control device. A hacking device may pre-obtain data of the remote control device and store the acquired data therein. If the driver is not present in the vehicle, previously stored data of the remote control device is transmitted to the vehicle, such that the vehicle unavoidably mistakes control of the hacking device for control of the remote control device.

SUMMARY

The present disclosure provides a remote control device having high security and low power consumption, a vehicle for determining approval or denial of a user command received from the remote control device, and a method for controlling the vehicle.

Additional aspects of the present disclosure will be set forth in part in the description which follows and, in part, will be obvious from the description, or may be learned by practice of the present disclosure.

In accordance with one aspect of the present disclosure, a vehicle includes a timer, a receiver, a storage, and a controller. The timer is configured to measure a time. The receiver is configured to receive data from a remote control device. The storage is configured to store a unique value of a vehicle, a timer count value of the vehicle, and a timer difference value between the remote control device and the vehicle. The controller configured to increase the timer count value of the vehicle after lapse of a predetermined time, compare a unique value of the remote control device contained in the data with the unique value of the vehicle stored in the storage, and determine whether a user command contained in the data is approved on the basis of a result of the comparison. When the unique value of the vehicle is identical to the unique value of the remote control device, and when a comparison resultant value obtained when a timer difference value stored in the storage is compared with a difference value between the timer count value of the vehicle and a timer count value of the remote control device contained in the data is present in an allowable error range, the controller is configured to approve the user command.

When the unique value of the vehicle is identical to the unique value of the remote control device and a comparison resultant value obtained when a timer difference value stored in the storage is compared with a difference value between the timer count value of the vehicle and the timer count value of the remote control device is present in the allowable error range, the controller may store a difference value between the timer count value of the vehicle and the timer count value of the remote control device, as the timer difference value, in the storage.

When the unique value of the vehicle is less than the unique value of the remote control device, the controller may allow the unique value of the vehicle stored in the storage to be identical to the unique value of the remote control device.

When the unique value of the vehicle is less than the unique value of the remote control device, the controller may store a difference value between the timer count value of the vehicle and the timer count value of the remote control device, as the timer difference value, in the storage, and approve the user command.

The receiver may receive the data over a radio frequency (RF) communication network.

The receiver may receive data from a plurality of remote control devices. The storage may store the unique value of the vehicle, the timer count value of the vehicle, and the timer difference value between the remote control device and the vehicle while being classified based on the respective remote control devices. The controller may determines whether the user command for each remote control device is approved.

In accordance with another aspect of the present disclosure, a remote control device includes an input, a timer, a transmitter, a storage, and a controller. The input is configured to receive a user command. The timer is configured to measure a time. The transmitter is configured to transmit data including the user command. The storage is configured to store a unique value of a remote control device, a first timer count value, a second timer count value, and a maximum value of the second timer count value. The controller is configured to increase the first timer count value and the second timer count value after lapse of a predetermined time, and configured to stop operation of the timer after increasing the unique value of the remote control device when the second timer count value reaches the maximum value.

Upon receiving the user command, the controller may operate the timer and controls the transmitter to transmit the data.

Upon receiving the user command, the controller may operate the timer, and control the transmitter to transmit data that include the first timer count value, the unique value of the remote control device, and the user command.

Upon receiving the user command, the controller may change the second timer count value stored in the storage to an initial value.

The transmitter may transmit the data through a radio frequency (RF) communication network.

When an abnormal situation occurs in the remote control device, the controller may change the unique value of the remote control device stored in the storage to an initial value.

The remote control device may be a key fob.

In accordance with another aspect of the present disclosure, a method for controlling a vehicle includes: operating a timer by a controller; increasing, by the controller, a timer count value of a vehicle after lapse of a predetermined time; receiving, by a receiver, data from a remote control device; comparing, by the controller, a unique value pre-stored in the vehicle with a remote control device's unique value contained in the data; and determining, by the controller, whether a user command contained in the data is approved on the basis of a result of the comparison. The determining whether the user command is approved includes approving the user command, when the unique value of the vehicle is identical to the unique value of the remote control device and a comparison resultant value obtained when a timer difference value pre-stored in the vehicle is compared with a difference value between the timer count value of the vehicle and a timer count value of the remote control device contained in the data is present in an allowable error range.

The determining whether the user command is approved may further include when the unique value of the vehicle is identical to the unique value of the remote control device and a comparison resultant value obtained when a timer difference value pre-stored in the vehicle is compared with a difference value between the timer count value of the vehicle and the timer count value of the remote control device contained in the data is present in the allowable error range, storing a difference value between the timer count value of the vehicle and the timer count value of the remote control device as the timer difference value.

The determining whether the user command is approved may include when the unique value of the vehicle is less than the unique value of the remote control device, controlling the unique value of the vehicle to be identical to the unique value of the remote control device.

The determining whether the user command is approved may include when the unique value of the vehicle is less than the unique value of the remote control device, storing a difference value between the timer count value of the vehicle and the timer count value of the remote control device as the timer difference value, and approving the user command.

The receiving the data may include receiving data over a radio frequency (RF) communication network.

The receiving the data may include receiving data from a plurality of remote control devices, and the determining whether the user command is approved may be performed for each remote control device.

The approving the user command may include when a difference value between the timer count value of the vehicle and the timer count value of the remote control device contained in the data is equal to or less than a sum of the timer difference value pre-stored in the vehicle and a predetermined reference value, determining that a comparison resultant value is present in the allowable error range.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 5 is a conceptual diagram illustrating that data stored in the vehicle and the remote control device is arranged in storage tables;

Figure 1:
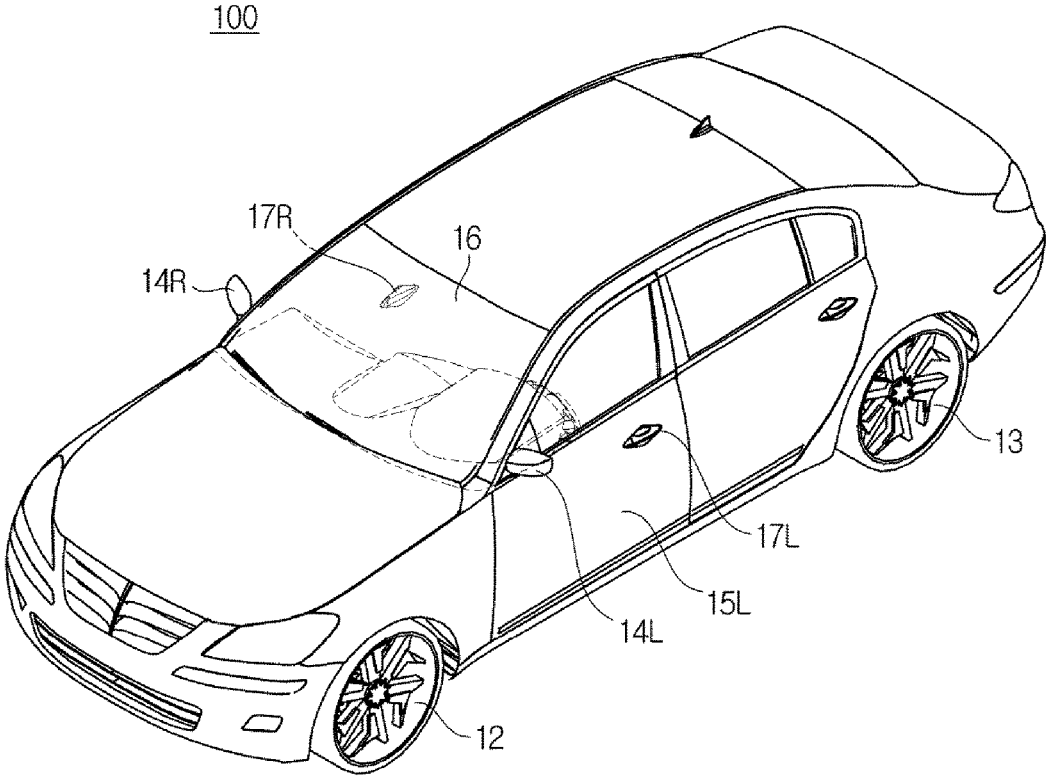
FIG. 1 is a perspective view illustrating the appearance of a vehicle.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

The exemplary forms may, however, be embodied in many different forms and should not be construed as being limited to the forms set forth herein. These forms are provided so that this disclosure will be thorough and complete and will fully convey the exemplary forms to those of ordinary skill in the art.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular forms only and is not intended to be limiting. As used herein, the singular forms "a," "an," and "the," are intended to include the plural forms as well, unless the context clearly indicates otherwise.

Figure 2:
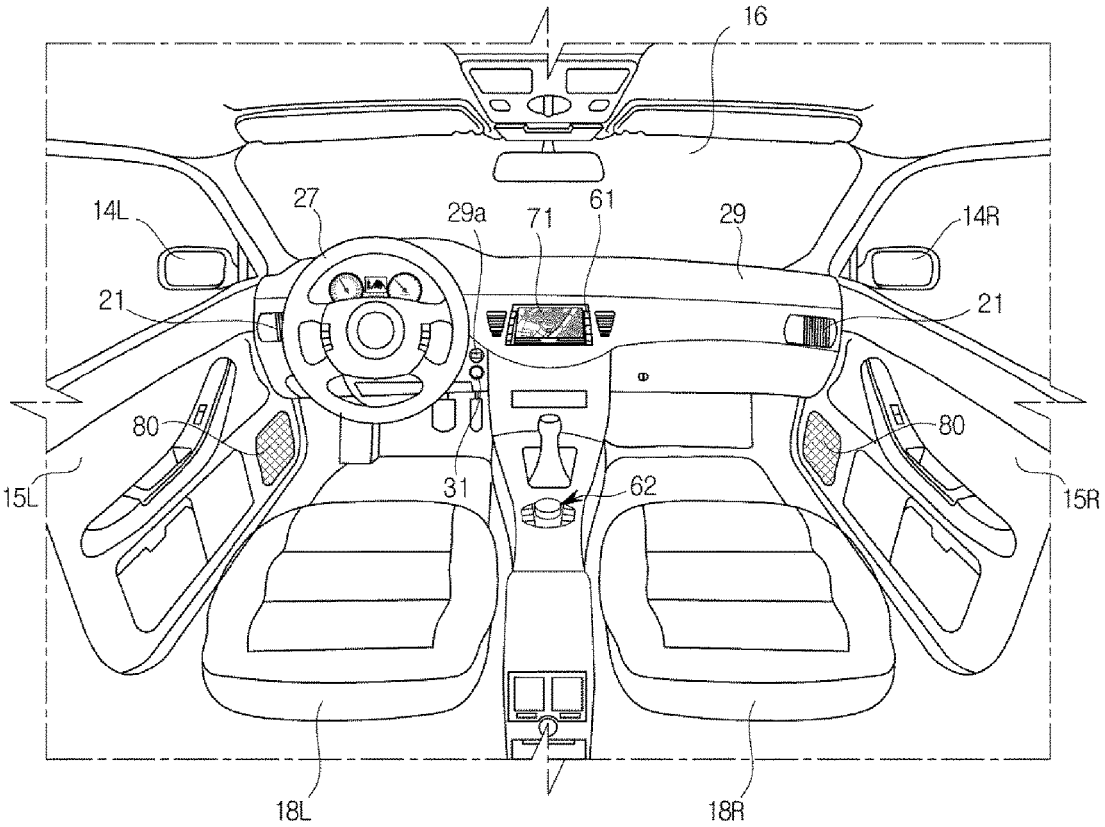
FIG. 2 is a view illustrating the internal structure of the vehicle.

FIG. 1 is a perspective view illustrating the appearance of a vehicle according to one form of the present disclosure. FIG. 2 is a view illustrating the internal structure of the vehicle in one form of the present disclosure.

Referring to FIG. 1, the appearance of the vehicle 100 according to the form includes vehicle wheels 12 and 13 to move the vehicle 100 from place to place, doors 15L to shield an indoor space of the vehicle 100 from the outside, a vehicle windshield 16 to provide a forward view of the vehicle 100 to a vehicle driver who rides in the vehicle 100, and side-view mirrors 14L and 14R to provide a backward view of the vehicle 100 to the vehicle driver.

The wheels 12 and 13 may include front wheels 12 provided at the front of the vehicle and rear wheels 13 provided at the rear of the vehicle. A drive device (not shown) installed in the vehicle 100 may provide rotational force to the front wheels 12 or the rear wheels 13 in a manner that the vehicle 100 moves forward or backward. The drive device (not shown) may include an engine to generate rotational force by burning fossil fuels or a motor to generate rotational force upon receiving a power source from a condenser.

The doors 15L and 15R (see FIG. 2) are rotatably provided at the right and left sides of the vehicle 100 so that a vehicle driver can ride in the vehicle 100 when any of the doors 15L and 15R is open and an indoor space of the vehicle 100 can be shielded from the outside when the doors 15L and 15R are closed. In addition, knobs 17L and 17R to open or close the doors 15L and 15R may be provided at the outside of the vehicle 100, and a Low Frequency (LF) antenna 111*a* and 111*c* (see FIG. 3) to transmit the LF signal and a touch sensor (not shown) to recognize the user touch input may be mounted to the knob 17L.

If the touch sensor of the doors 15L and 15R detects the user touch input of the doors 15L and 15R under the condition that the user holds the remote control device 200 (see FIG. 3), the vehicle 100 may authenticate the remote control device 200 over a wireless communication network. If authentication is completed, door lock of the vehicle 100 is released, and the door 15L may be opened by the user who pulls the knobs 17L and 17R. Here, the term "user" may include not only a vehicle driver but also one or more passengers who ride in the vehicle 100, and may indicate a user who holds the remote control device 200.

The windshield 16 is provided at a front upper portion of the vehicle 100 so that a vehicle driver who rides in the vehicle 100 can obtain visual information of a forward direction of the vehicle 100. The windshield 16 may also be referred to as a windshield glass.

The side-view mirrors 14L and 14R may include a left side-view mirror 14L provided at the left of the vehicle 100 and a right side-view mirror 14R provided at the right of the vehicle 100, so that the driver who rides in the vehicle 100 can obtain visual information of the lateral and rear directions of the vehicle 100.

Besides, the vehicle 100 may include a variety of sensing devices, for example, a proximity sensor to detect the presence of obstacles located at the lateral and rear directions of the vehicle 100, a rain sensor to detect the presence or absence of rainfall and the amount of rainfall, etc.

Referring to FIG. 2, an Audio Video Navigation (AVN) display 71 and the AVN input 61 may be mounted to the center region of a dashboard 29. The AVN display 71 may selectively display at least one of an audio screen image, a video screen image, and a navigation screen image. In addition, the AVN display 71 may display various control screen images related to the vehicle 100 or screen images related to additional functions.

The AVN display 71 may be implemented by any one of a Liquid Crystal Display (LCD), a Light Emitting Diode (LED), a Plasma Display Panel (PDP), an Organic Light Emitting Diode (OLED), a Cathode Ray Tube (CRT), etc.

The AVN input 61 formed in a hard key shape may be mounted to one region adjacent to the AVN display 71. If the AVN display 71 is implemented as a touchscreen, the AVN display may also be implemented as a touch panel at the front surface of the AVN display 71.

A center input 62 may be implemented as a jog-wheel located between the driver seat 18L and the passenger seat 18R. The user may input a control command by moving the center input 62 forward or backward and to the left or right or by pressing or turning the center input 62.

The vehicle 100 may include a sound output 80 to output the acoustic or sound signal. The sound output unit 80 may be implemented as a speaker. The sound output 80 may output the acoustic or sound signal needed to perform the audio function, the video function, the navigation function, and other additional functions.

The steering wheel 27 may be mounted to the dashboard 29 located adjacent to the driver seat 18L, and a keyhole 29*a* in which the remote control device 200 (e.g., a key fob of FIG. 3) can be inserted may be formed close to the steering wheel 27. If the remote control device 200 is inserted into the keyhole 29*a* or if authentication between the remote control device 200 and the vehicle 100 is completed over a wireless communication network, the remote control device 200 and the vehicle 100 may communicate with each other.

In addition, the dashboard 29 may include a start button 31 to turn starting of the vehicle 200 on or off. The remote control device 200 may be inserted into the keyhole 29*a*. If authentication between the remote control device 200 and the vehicle 100 is completed over the wireless communication network, the vehicle 100 starts operation by the user who pushes the start button 31.

In the meantime, the vehicle 100 may include an air-conditioner configured to perform the heating and cooling function, and may control air temperature of the internal space of the vehicle 100 by discharging the heated or cooled air through an air outlet 21.

Figure 3:
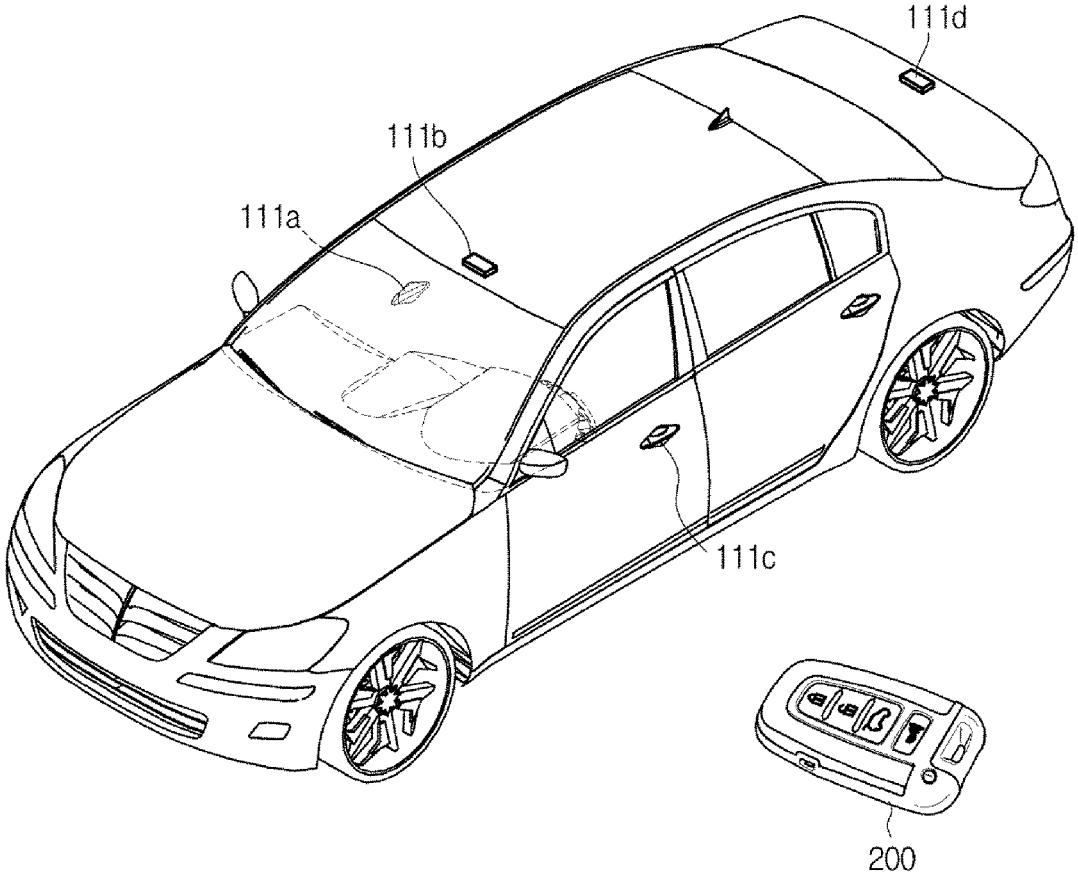
FIG. 3 is an exemplary view illustrating the vehicle and the remote control device communicating with the vehicle.

FIG. 3 is an exemplary view illustrating the vehicle and the remote control device communicating with the vehicle according to one form of the present disclosure.

Referring to FIG. 3, the remote control device 200 may directly contact the vehicle 100 or may be connected to the vehicle 100 through wireless communication.

As an example illustrated in FIG. 3, the remote control device 200 may be implemented as a key fob, which is connected to the vehicle 100 such that the door lock can be released and the vehicle can start operation and travel.

The remote control device 200 illustrated in FIG. 3 may include not only the key fob but also all kinds of input devices capable of releasing the door lock or controlling the vehicle 100 in a manner that the vehicle 100 can start operation or can start traveling. For example, if the mobile device serves as the remote control device, the remote control device 200 may also include one or more mobile devices therein. In this case, an application capable of performing the operations of the remote control device 200 may be installed at the mobile device. The application may be installed in the mobile device during the manufacturing process, and then introduced onto the market. After the mobile device including the application has been sold to consumers, the mobile device may download the application from the server according to a user request. In addition, an authentication procedure may be needed in a manner that the mobile device can operate as the remote control device 200 of the vehicle 100.

The remote control device 200 may be simultaneously sold to consumers along with the vehicle 100, and authentication information of the remote control device 200 may be pre-registered in the vehicle 100. In this case, a plurality of remote control devices 200 may be pre-registered in the vehicle 100 if desired.

In order to perform mutual authentication between the remote control device 200 and the vehicle 100, the remote control device 200 and the vehicle 100 may communicate with each other over a Low Frequency (LF) communication network and a Radio Frequency (RF) communication network.

The LF communication network may be a communication network having a low-frequency band less than 300 kHz used to transmit LF signals needed for the vehicle 100 searching for the remote control device 200. For example, the LF communication network may be a communication network having a frequency band of 20 kHz to 150 kHz. If one or more LF signals are transmitted and received through the LF communication network, the transmittable/receivable distance of the LF signal may be shorter than that of the RF communication network having a high frequency band because the LF communication network has unique characteristics caused by the low frequency (LF) band. For example, the LF signal transmittable/receivable distance is about 5 meters (5 m) long, and the RF signal transmittable/receivable distance is about 100 meters (100 m) long.

Therefore, the vehicle 100 transmits the LF signal over the LF communication network, such that the vehicle 100 can search for the remote control device 200 located adjacent to the vehicle 100 and can request information needed for authentication.

In order to transmit the LF signal, the vehicle 100 according to one form may include a low frequency (LF) transmitter, and the LF transmitter 111 may include one or more LF antennas 111*a* to 111*d*.

The LF antennas 111*a* to 111*d* may be respectively mounted to the front, rear, side, and inner surfaces of a main body of the vehicle 100, such that the LF antennas 111*a* to 111*d* may transmit the LF signal at various angles and intensities. The LF signal of the remote control device 200 may have different reception intensities and different reception directions according to installation positions of the LF antennas 111*a* to 111*d*.

Although FIG. 3 exemplarily shows the LF antenna 111*a* mounted to the knob 17R of the right door 15R, the LF antenna 111*c* mounted to the knob 17L of the left door 15L, the LF antenna 111*b* mounted to an upper end of the main body, and the LF antenna 111*d* mounted to the trunk for convenience of description and better understanding of the present disclosure, the scope or spirit of the installation positions of the LF antennas are not limited thereto.

If the vehicle 100 transmits the LF signals through the LF antennas 111*a* to 111*d*, the remote control device 200 may receive the LF signals from the respective LF antennas 111*a* to 111*d*.

The Radio Frequency (RF) communication network may be a communication network of one or more RF signals transmitted at a high frequency band of 300 kHz or higher. For example, the RF communication network may be a communication network configured to use an ultra high frequency (UHF) of 300 MHz to 3 GHz. In more detail, the RF communication network may be a communication network configured to use a frequency band of 300 MHz to 450 MHz. If one or more RF signals are transmitted and received through the RF communication network, the transmittable/receivable distance of the RF signal for use in the RF communication network may be longer than that of the LF signal for use in the LF communication network.

Figure 4:
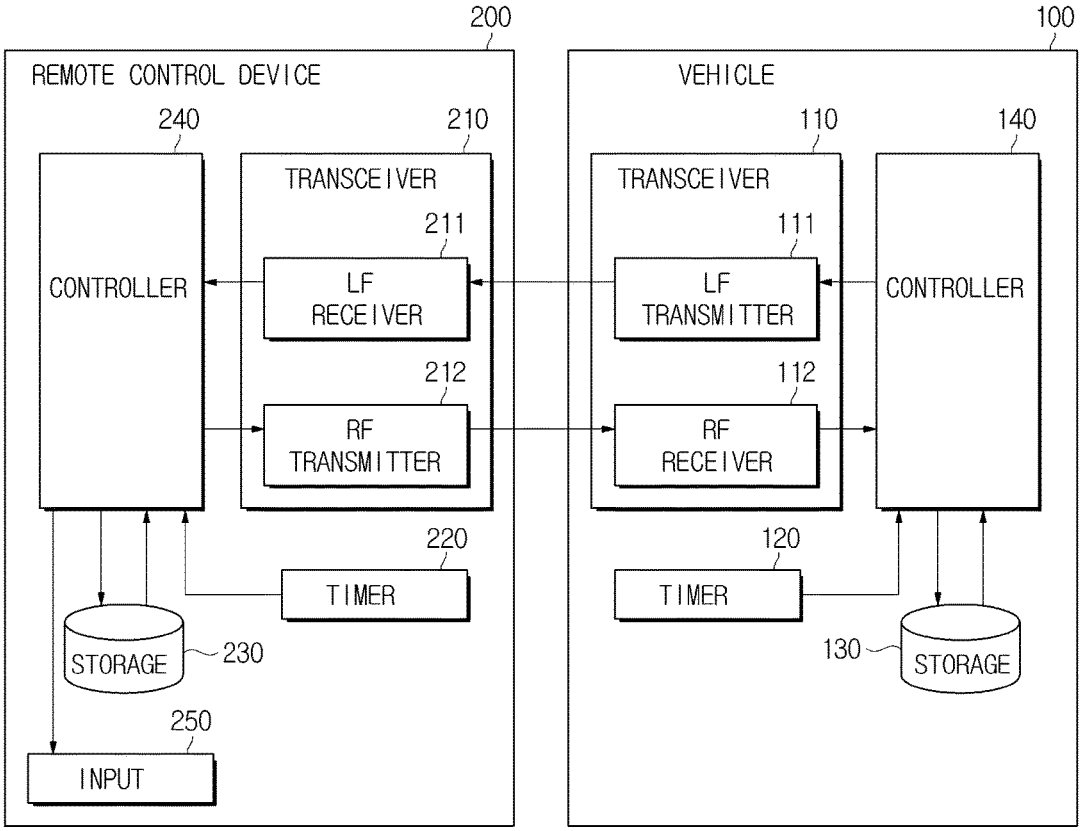
FIG. 4 is a control block diagram illustrating a vehicle and a remote control device.

FIG. 4 is a control block diagram illustrating a vehicle and a remote control device in one form of the present disclosure.

Referring to FIG. 4, the vehicle 100 may include a transceiver 110 to transmit/receive data, a timer 120 to measure a time, a storage 130 to store various kinds of information needed to control the vehicle 100, and a controller 140 to control respective constituent elements of the vehicle 100.

The transceiver 110 of the vehicle 100 may include an LF transmitter 111 to transmit one or more LF signals over the LF communication network, and an RF receiver 112 to receive one or more RF signals over the RF communication network.

As described above, when the LF signal is transmitted over the LF communication network, the LF signal may have a shorter transmittable/receivable distance than the RF signal of the RF communication network having a high frequency band because unique characteristics caused by the LF band occurs in the LF communication network. Therefore, the LF transmitter 111 may transmit the LF signal to the remote control device 200 located within the transmittable/receivable distance of the LF signal from the vehicle 100. As the remote control device 200 gradually approaches the vehicle 100, the remote control device 200 may receive a higher-intensity LF signal.

The LF transmitter 111 may have an LF communication interface including an LF antenna and an LF transmitter configured to transmit a radio signal (i.e., LF signal) in a frequency band of 300 kHz or less. In addition, the LF transmitter 111 may further include an LF signal conversion module configured to modulate a digital control signal generated from the controller 120 into an analog-type radio signal through the LF communication interface.

A plurality of LF antennas may be provided in the vehicle 100. The LF antennas may be provided at the front, rear, side, and inner surfaces of the main body, such that the LF antennas may transmit the LF signals at different angles and different intensities.

Although the LF antennas may include the LF antenna 111*a* mounted to the knob 17R of the right door 15R, the LF antenna 111*c* mounted to the knob 17L of the left door 15L, the LF antenna 111*b* mounted to the upper end of the main body, and the LF antenna 111*d* mounted to the trunk, as shown in FIG. 3, the scope or spirit of the present disclosure is not limited thereto.

The RF receiver 112 may receive one or more RF signals using the RF communication network. As described above, assuming that the RF receiver 112 receives the RF signal over the RF communication network, the transmittable/receivable distance of the RF signal may be longer than that of the LF signal for use in the LF communication network having a low frequency band because the RF signal has unique characteristics caused by a high frequency band.

The RF receiver 112 may have an RF communication interface including an RF antenna and an RF receiver configured to receive a radio signal (i.e., RF signal) in a frequency band of 300 kHz or higher. In addition, the RF receiver 112 may further include an RF signal conversion module configured to demodulate an analog-type radio signal received through the RF communication interface into a digital control signal.

If the remote control device 200 receives a command from the user, the RF receiver 112 may receive the user command from the remote control device 200 over the RF communication network. In this case, the user command received from the remote control device 200 may include a command for releasing door lock, a command for releasing trunk lock, an automatic parking command of the vehicle 100, and a manipulation command of the vehicle 100 corresponding to various functions supplied from the remote control device 200.

In addition, the RF receiver 112 may further receive data including not only a timer count value of the remote control device 200 but also a unique value of the remote control device 200 from the remote control device 200. The timer count value of the remote control device 200 and the unique value of the remote control device 200 will hereinafter be described.

The RF receiver 112 according to one form may also receive data from the plurality of remote control devices 200.

If the remote control devices 200 are registered in the vehicle 100, the remote control devices 200 may transmit independent user commands, count values, and unique values to the vehicle 100.

In the meantime, the vehicle 100 and the remote control device 200 may transmit and receive data according to various wireless communication schemes, and a communication method between the vehicle 100 and the remote control device 200 is not limited to the LF communication scheme and the RF communication scheme.

The timer 120 may measure or confirm a current time in real time. After lapse of a predetermined time (e.g., 1 minute), the timer 120 may change a turn-on state or a turn-off state of a circuit, such that the timer 120 may directly measure the current time. However, the timer 120 may also measure the current time by acquiring time information from the external device.

The timer 120 according to one form may start operation according to an operation start command, and may stop operation according to an operation stop command.

The storage 130 may store data needed to control the vehicle 100.

The storage 130 may be a memory that is implemented as a separate chip independent from a processor of the controller 140 to be described later, or may be implemented as a processor and a single chip. Although the storage 130 may be implemented as any one of a non-volatile memory (e.g., a cache, a Read Only Memory (ROM), a Programmable ROM (PROM), an Erasable Programmable ROM (EPROM), an Electrically Erasable Programmable ROM (EEPROM), a flash memory, etc.), a volatile memory (e.g., a Random Access Memory (RAM)), and a storage medium (e.g., a Hard Disk Drive (HDD), a CD-ROM, etc.), the scope or spirit of the present disclosure is not limited thereto.

The storage 130 may store a timer count value of the vehicle 100, a unique value of the vehicle 100, and a timer difference value between the remote control device 200 and the vehicle 100.

After lapse of a predetermined time, the timer count value of the vehicle 100 may increase by the controller 140. For example, after lapse of 1 minute, the timer count value stored in the storage 130 may be changed from 0 (i.e., an initial value) to 1. Thereafter, after lapse of the next 1 minute, the timer counter value stored in the storage 130 may be changed from 1 to 2.

The unique value of the vehicle 100 may be predetermined when the remote control device 200 is initially registered. Thereafter, when the subsequent authentication process is performed in future, the unique value of the vehicle 100 may be compared with a unique value of the remote control device 200.

If the remote control device 200 is initially registered, an initial value of the unique value of the vehicle 100 may be predetermined to be equal to or less than an initial value of the unique value of the remote control device 200. If an abnormal situation occurs in the remote control device 200, the unique value of the remote control device 200 may increase. As a result, if the normal remote control device 200 normally registered in the vehicle 200 transmits data, the unique value of the vehicle 100 may be equal to or less than the unique value received from the remote control device 200. Accordingly, if the unique value of the vehicle 100 is higher than the unique value of the remote control device 200, this means the presence of a hacking attempt.

The timer difference value between the remote control device 200 and the vehicle 100 may be a difference value between a timer count value stored in the storage 130 and a timer count value received from the remote control device 200, and may be stored by the controller 140.

In association with the plurality of remote control devices 200, the storage 140 of the vehicle according to one form may also store a unique value of the vehicle 100 for each remote control device 200, a timer count value of the vehicle 100 for each remote control device 200, and a timer difference value between the remote control device 200 and the vehicle 100 for each remote control device 200.

The controller 140 may generate a control signal for controlling constituent elements of the vehicle 100.

The controller 140 may be implemented as an algorithm for controlling the constituent elements contained in the vehicle 100, a memory (not shown) for storing data regarding a program implementing the algorithm, and a processor (not shown) for performing the above-mentioned operation using data stored in the memory. In this case, the memory and the processor may also be implemented as different chips if desired. Alternatively, the memory and the processor may be implemented as a single chip.

The controller 140 according to one form may increase the vehicle 100's timer count value stored in the storage 130 after lapse of a predetermined time (e.g., 1 minute). The controller 140 may compare the unique value received from the remote control device 200 with the unique value of the vehicle 100 stored in the storage 130, and may determine whether to approve a user command received from the remote control device 200 based on the result of comparison. A detailed method for deciding the approval or denial of the user command (i.e., a method for authenticating the remote control device 200) will be described later with reference to FIG. 9.

If the RF receiver 112 receives data from the plurality of remote control devices 200, the controller 140 according to one form may also determine whether to approve the user command for each remote control device 200.

The control signal of the vehicle 100, the RF signal, and the LF signal may include different formats.

The constituent elements of the remote control device 200 according to one form will hereinafter be described.

The remote control device 200 may include a transceiver 210 to transmit/receive data, a timer 220 to measure a time, a storage 230 to store various kinds of information needed to control the remote control device 200, a controller 240 to control constituent elements of the remote control device 200, and an input 250 to receive a user command as an input.

The transceiver 210 may include an LF receiver 211 to receive the LF signal through the LF communication network, and an RF receiver 212 to transmit the RF signal through the RF communication network.

The LF receiver 211 may have an LF communication interface including an LF antenna and an LF receiver configured to receive a radio signal (i.e., LF signal) in a frequency band of 300 kHz or less. In addition, the LF receiver 211 may further include an LF signal conversion module configured to demodulate an analog-type radio signal received through the LF communication interface into a digital control signal.

The RF transmitter 212 may have an RF communication interface including an RF antenna and an RF transmitter configured to transmit a radio signal (i.e., RF signal) in a frequency band of 300 kHz or higher. In addition, the RF transmitter 212 may further include an RF signal conversion module configured to modulate a digital control signal generated from the controller 240 into an analog-type radio signal.

If the input 250 receives a command from the user, the RF transmitter 212 may transmit a user command to the vehicle 100 over the RF communication network. In this case, the user command received from the input 250 may include a command for releasing door lock, a command for releasing trunk lock, an automatic parking command of the vehicle 100, and a manipulation command of the vehicle 100 corresponding to various functions supplied from the remote control device 200.

In addition, the RF transmitter 212 may further transmit data including not only a timer count value of the remote control device 200 but also a unique value of the remote control device 200 to the vehicle 100. The timer count value of the remote control device 200 and the unique value of the remote control device 200 will hereinafter be described.

In the meantime, the remote control device 200 and the vehicle 100 may also transmit and receive data according to various wireless communication schemes, such that a communication scheme between the remote control device 200 and the vehicle 100 is not limited to the LF communication scheme and the RF communication scheme.

The timer 220 may measure or confirm a current time in real time. After lapse of a predetermined time (e.g., 1 minute), the timer 220 may change a turn-on state or a turn-off state of a circuit, such that the timer 220 may directly measure the current time. However, the timer 220 may also measure the current time by acquiring time information from the external device.

The timer 220 of the remote control device 200 and the timer 120 of the vehicle 100 may operate independently, such that a time measured by the timer 220 of the remote control device 200 may be different from a time measured by the timer 120 of the vehicle 100.

The storage 230 may store data needed to control the remote control device 200.

The storage 230 may be a memory that is implemented as a separate chip independent from a processor of the controller 240 to be described later, or may be implemented as a processor and a single chip. Although the storage 230 may be implemented as any one of a non-volatile memory (e.g., a cache, a Read Only Memory (ROM), a Programmable ROM (PROM), an Erasable Programmable ROM (EPROM), an Electrically Erasable Programmable ROM (EEPROM), a flash memory, etc.), a volatile memory (e.g., a Random Access Memory (RAM)), and a storage medium (e.g., a Hard Disk Drive (HDD), a CD-ROM, etc.), the scope or spirit of the present disclosure is not limited thereto.

The storage 230 may store first and second timer count values of the remote control device 200, a unique value of the remote control device 200, and a maximum value of the second timer count value of the remote control device 200.

After lapse of a predetermined time, the first and second timer count values of the remote control device 200 may increase by the controller 240. For example, after lapse of 1 minute, each of the first and second timer count values stored in the storage 230 may be changed from 0 (i.e., an initial value) to 1. Thereafter, after lapse of the next 1 minute, each of the first and second timer counter values stored in the storage 230 may be changed from 1 to 2. However, the second timer count value may be changed to the initial value when the input 250 of the remote control device 200 receives the user command.

The unique value of the remote control device 200 may indicate an abnormal situation of the remote control device 200, and may be compared with the unique value of the vehicle 100 when the vehicle 100 performs authentication in a subsequent process.

The initial value of the unique value of the remote control device 200 may be predetermined to be equal to or higher than the initial value of the unique value of the vehicle 100. The unique value of the remote control device 200 may increase whenever the abnormal situation (e.g., the case in which the remote control device 200 is not used for a long period of time) occurs. The unique value received from the normal remote control device 200 may be equal to or higher than the unique value of the vehicle 100. Accordingly, if the unique value of the remote control device 200, received by the vehicle 100, is less than the unique value of the vehicle 100, this means the presence of a hacking attempt. For example, the initial value of the unique value of the remote control device 200 may be preset to 1, and the initial value of the vehicle 100 may be preset to 0.

The maximum value of the second timer count value may be a reference value for recognizing that the remote control device 200 is not used for a long period of time. If the remote control device 200 is initially registered in the vehicle 100, the maximum value of the second timer count value may be pre-stored in a delivery stage, or may be directly entered by the user.

The controller 240 may generate a control signal for controlling constituent elements of the remote control device 200.

The controller 240 may be implemented as an algorithm for controlling the constituent elements contained in the remote control device 200, a memory (not shown) for storing data regarding a program implementing the algorithm, and a processor (not shown) for performing the above-mentioned operation using data stored in the memory. In this case, the memory and the processor may also be implemented as different chips if desired. Alternatively, the memory and the processor may be implemented as a single chip.

If a predetermined time elapses on the basis of a time measured by the timer 220, the controller 240 may increase the first and second timer count values of the remote control device 200 stored in the storage 230. However, when the timer 220 stops operation, the controller 240 may not increase the first and second timer count values.

When the second timer count value reaches the maximum value (i.e., when the remote control device 200 is not used for a long period of time), the controller 240 may increase the unique value of the remote control device 200, and may stop the timer 220 to reduce power consumption of the timer 220.

When the second timer count value reaches the maximum value and the timer 220 stops operation, the controller 240 may not increase the first timer count value and the second timer count value before receiving the user command through the input 250.

However, the timer 220 may continuously operate before the second timer count value reaches the maximum value, and the first timer count value and the second timer count value may increase whenever the predetermined time elapses.

The controller 240 may determine whether the timer 220 is operating upon receiving the user command through the input 250. When the timer 220 stops operation, the controller 240 may resume the timer 220. The controller 240 may control the RF transmitter 212 to transmit data that includes the received user command, the first timer count value stored in the storage 230, and the unique value of the remote control device 200 stored in the storage 230. After the RF transmitter 212 transmits the above data, the controller 240 may change the second timer count value of the remote control device 200 stored in the storage 230 to the initial value.

In the meantime, the controller 240 may increase the unique value of the remote control device 200 stored in the storage 230 even when an abnormal situation occurs in the remote control device 200 (e.g., even when a battery of the remote control device 200 is replaced with a new battery).

The control signal of the remote control device 200, the RF signal, and the LF signal may have different formats.

The input 250 of the remote control device 200 may include hardware devices (e.g., various buttons, switch, track ball, etc.) configured to receive user commands needed to remote-control various constituent elements of the vehicle 100 from the user. Here, the user commands may include a command for releasing door lock of the doors 71 and 72 (see FIG. 2), a command for allowing the vehicle to honk a horn, a command for releasing trunk lock, etc.

The input 250 may be implemented as a graphical user interface (GUI) such as a touch pad for user input. That is, the input 250 may include a software input device such as GUI. The touch pad may be implemented as a touch screen panel (TSP).

Figure 6:
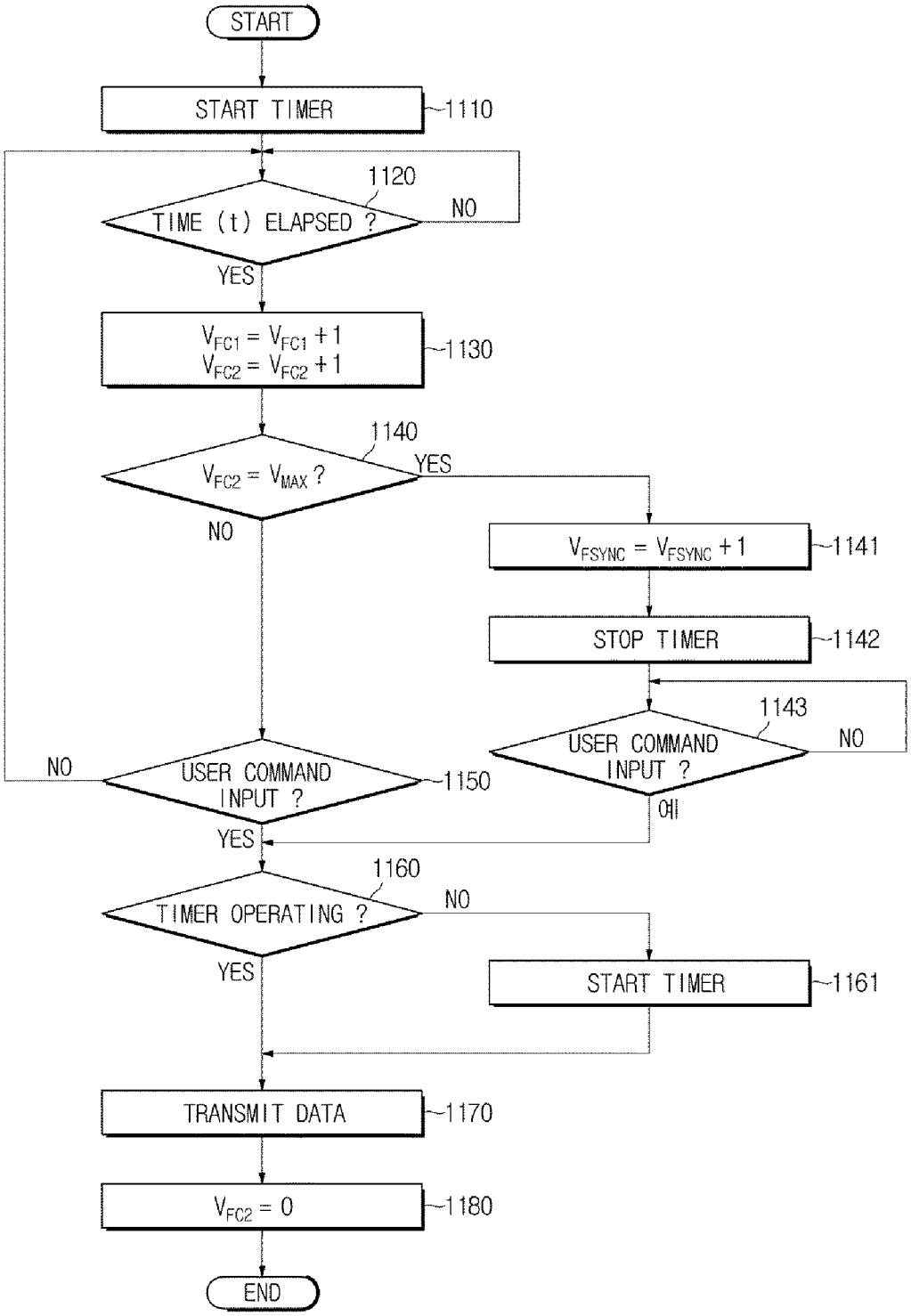
FIG. 6 is a flowchart illustrating a method for controlling the remote control device.
Figure 7:
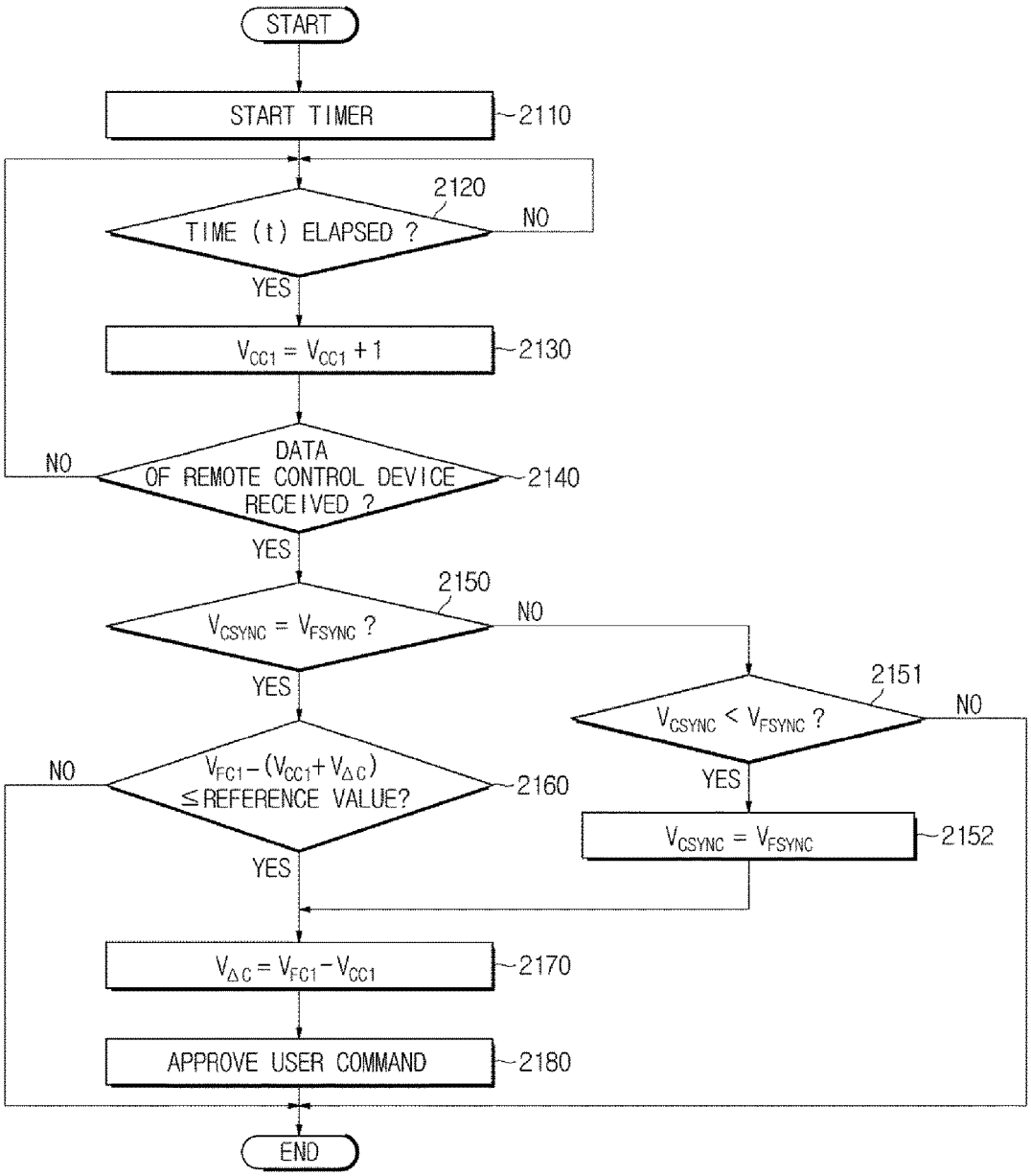
FIG. 7 is a flowchart illustrating a method for controlling the vehicle.

A method for controlling the vehicle 100 and the remote control device 200 in one form will hereinafter be described with reference to FIGS. 5 to 7. FIG. 5 is a conceptual diagram illustrating that data stored in the vehicle and the remote control device is arranged in storage tables. FIG. 6 is a flowchart illustrating a method for controlling the remote control device. FIG. 7 is a flowchart illustrating a method for controlling the vehicle.

Referring to FIG. 5, the storage 230 of the remote control device 200 may include a first timer count value $V_{FC1}$, a second timer count value $V_{FC2}$, a maximum value $V_{MAX}$ of the second timer count value, and a unique value $V_{FSYNC}$ of the remote control device 200.

If the remote control device 200 is initially registered in the vehicle 100, the first timer count value $V_{FC1}$, the second timer count value $V_{FC2}$, and the unique value $V_{FSYNC}$ may be preset to initial values, and may be increased or reset to the initial values under control of the controller 240.

The maximum value $V_{MAX}$ of the second timer count value may be preset when the remote control device 200 is initially registered in the vehicle 100, or may be entered by the user through the input 250. The maximum value $V_{MAX}$ of the second timer count value may not increase or decrease under control of the controller 240 to be described later.

The storage 130 of the vehicle may store a timer count value $V_{CC1}$ of the vehicle 100, a timer difference value $V_{\Delta C}$ between the vehicle 100 and the remote control device 200, and a unique value $V_{CSYNC}$ of the vehicle 100.

The timer count value $V_{CC1}$ of the vehicle 100 may be preset to the initial value when the remote control device 200 of the vehicle 100 is initially registered in the vehicle 100, and may increase under control of the controller 140.

The timer difference value $V_{\Delta C}$ between the vehicle 100 and the remote control device 200 may be a difference value between the timer count value $V_{CC1}$ of the vehicle 100 and the first timer count value $V_{FC1}$ of the remote control device 200, and may be stored by the controller 140.

The initial value of the unique value $V_{CSYNC}$ of the vehicle 100 may be predetermined when the remote control device 200 of the vehicle 100 is registered in the vehicle 100.

A method for controlling the vehicle 100 and the remote control device 200 will hereinafter be described with reference to FIGS. 6 and 7, and a method for using data stored in the storage 130 of the vehicle 100 and the storage 230 of the remote control device 230 will hereinafter be given.

Referring to FIG. 6, the controller 240 of the remote control device 200 may operate the timer 220 of the remote control device 200 (Operation 1110). Whenever a predetermined time (t) (for example, 1 minute) elapses (Operation 1120), the controller 240 may respectively increase each of the first timer count value $V_{FC1}$ and the second timer count value $V_{FC2}$ stored in the storage 230 by one (i.e., value "1") (Operation 1130).

Subsequently, the controller 240 of the remote control device 200 may determine whether the second timer count value $V_{FC2}$ reaches the maximum value $V_{MAX}$ (Operation 1140). Before the second timer count value $V_{FC2}$ reaches the maximum value $V_{MAX}$ (Operation 1140), the controller 240 may increase each of the first timer count value $V_{FC1}$ and the second timer count value $V_{FC2}$ stored in the storage 230 (Operation 1130) whenever the predetermined time (t) elapses (Operation 1120).

In contrast, when the second timer count value $V_{FC2}$ stored in the storage 230 reaches the maximum value $V_{MAX}$ (Operation 1140) (i.e., when the remote control device 200 is not used for a long period of time), the controller 240 of the remote control device 200 may increase the unique value $V_{FSYNC}$ of the remote control device 200 stored in the storage 230 (Operation 1141), and may stop the timer 220 of the remote control device 200 (Operation 1142).

Meanwhile, when the input 250 receives a user command (Operations 1143 and 1150), the controller 240 of the remote control device 200 may operate the timer (Operations 1160 and 1161), and may control the RF transmitter 212 to transmit data, that includes the received user command, the first timer count value $V_{FSYNC}$ stored in the storage 230, and the unique value of the remote control device 200 stored in the storage 230, to the vehicle 100 over the RF communication network (Operation 1170).

The operations 1160 and 1161 for operating the timer 220 may include determining (Operation 1160) whether the timer 220 is operating, and operating the timer 220 when the timer 220 does not operate (Operation 1161).

When the input 250 receives a user command (Operations 1141 and 1150), the controller 240 of the remote control device 200 may change the second timer count value $V_{FC2}$ stored in the storage 230 to the initial value (e.g., 0) (Operation 1180).

Although not shown in the drawings, after the second timer count value $V_{FC2}$ is changed to the initial value, the controller 240 may increase the first timer count value $V_{FC1}$ and the second timer count value $V_{FC2}$ (Operation 1130) whenever the predetermined time (t) elapses again (Operation 1120).

Referring to FIG. 7, the controller 140 of the vehicle 100 may operate the timer 120 of the vehicle 100 (Operation 2110). Before the controller 140 receives data from the remote control device 200 (Operation 2140), the controller 140 may increase the timer count value ($V_{CC1}$) of the vehicle 100 stored in the storage 130 by one (Operation 2130) whenever the predetermined time (t) (e.g., 1 minute) elapses (Operation 2120).

When the RF receiver 112 receives data from the remote control device 200 (Operation 2140), the controller 140 of the vehicle 100 may compare the unique value $V_{CSYNC}$ of the vehicle 100 stored in the storage 130 with the unique value $V_{FSYNC}$ of the remote control device 200 contained in the data received from the remote control device 200 (Operation 2150).

As described above, the unique value $V_{FSYNC}$ of the remote control device 200 may increase whenever an abnormal situation occurs, and the unique value $V_{CSYNC}$ of the vehicle 100 may be maintained at the initial value in a different way from the unique value $V_{FSYNC}$ of the remote control device 200, such that the unique value $V_{FSYNC}$ of the normal remote control device 200 must be equal to or higher than the unique value $V_{CSYNC}$ of the vehicle 100.

Therefore, when the unique value $V_{CSYNC}$ of the vehicle 100 stored in the storage 130 is identical to the unique value $V_{FSYNC}$ of the remote control device 200 contained in the data received from the remote control device 200 (Operation 2150) (i.e., when the remote control device 200 is frequently used), the controller 140 of the vehicle 100 may determine whether a comparison resultant value obtained when the timer difference value $V_{\Delta C}$ stored prior to reception of current data is compared with a difference value between the timer count value $V_{CC1}$ of the vehicle 100 and the first timer count value $V_{FC1}$ of the remote control device 200 contained in data received from the remote control device 200 is present in an allowable error range (Operation 2160). In more detail, in operation 2160, the controller 140 may compare a difference value between the timer count value $V_{CC1}$ of the vehicle 100 and the first timer count value $V_{FC1}$ of the remote control device 200 contained in the data currently received from the remote control device 200 with the sum of a predetermined reference value and the pre-stored timer difference value $V_{\Delta C}$.

If the comparison resultant value is present in the allowable error range (Operation 2160) (i.e., if a difference value between the timer count value $V_{CC1}$ and the first timer count value $V_{FC1}$ of the remote control device 200 contained in the data received from the remote control device 200 is equal to or less than the sum of a predetermined reference value and the pre-stored timer difference value $V_{\Delta C}$ in operation 2160), the timer difference value $V_{\Delta C}$ stored in the storage 140 may be updated to a difference value between the timer count value $V_{CC1}$ of the vehicle 100 and the first timer count value $V_{FC1}$ of the remote control device 200 contained in the data currently received from the remote control device 200 (Operation 2170). Subsequently, the controller 140 may approve or permit a user command contained in the data currently received from the remote control device 200 (Operation 2180).

By the above-mentioned operations, although the timer 120 of the vehicle 100 and the timer 220 of the remote control device 200 are operated independently from each other, the vehicle 100 may recognize a time difference between the timer count values of the vehicle 100 and the remote control device 200, such that time substantial synchronization between the vehicle 100 and the remote control device 200 can be achieved.

In contrast, if the comparison resultant value is not present in the allowable error range (i.e., if a difference value between the timer count value $V_{CC1}$ of the vehicle 100 and the first timer count value $V_{FC1}$ of the remote control device 200 contained in the data currently received from the remote control device 200 is higher than the sum of the predetermined reference value and the pre-stored timer difference value $V_{\Delta C}$ in Operation 2160), the controller 140 may determine the presence of a hacking attempt and may not approve the user command.

If the unique value of the vehicle 100 stored in the storage 130 is less than the unique value of the remote control device 200 contained in the data received from the remote control device 200 (Operations 2150 and 2151), the controller 140 of the vehicle 100 may determine the occurrence of an abnormal situation in the remote control device 200, and may update the timer difference value $V_{\Delta C}$ stored in the storage 140 to a difference value between the timer count value $V_{CC1}$ of the vehicle 100 and the first timer count value $V_{FC1}$ of the remote control device 200 contained in data currently received from the remote control device 200 so as to perform time synchronization with the remote control device 200 (Operation 2170). The controller 140 of the vehicle 100 may approve the user command contained in the data received from the remote control device 200 (Operation 2180).

In addition, if the unique value of the vehicle 100 stored in the storage 130 is higher than the unique value of the remote control device 200 contained in the data currently received from the remote control device 200 (Operations 2150 and 2151), the controller 140 of the vehicle 100 may determine the presence of a hacking attempt, and may not approve the user command.

Although not shown in the drawings, differently from the above-mentioned case in which the user command is approved or denied, the controller 140 may increase the timer count value ($V_{CC1}$) (Operation 2130) whenever the predetermined time (t) elapses (Operation 2120).

As is apparent from the above description, since the remote control device and the vehicle in the forms of the present disclosure can perform an authentication process using real-time temporal information, the remote control device and the vehicle can inhibit or prevent an abnormal user command caused by fraudulent signal replication of the hacking device from being acknowledged by the vehicle.

Although a few forms of the present disclosure have been shown and described, it would be appreciated by those skilled in the art that changes may be made in these forms without departing from the principles and spirit of the present disclosure.

What is claimed is:

1. A vehicle comprising:

a timer configured to measure a time;

a receiver configured to receive data from a remote control device;

a storage configured to store a unique value of a vehicle, a timer count value of the vehicle, and a timer difference value between the remote control device and the vehicle; and a controller configured to increase the timer count value of the vehicle after lapse of a predetermined time, compare a unique value of the remote control device contained in the data with the unique value of the vehicle stored in the storage, and determine whether a user command contained in the data is approved based on a result of the comparison, wherein, the controller is configured to approve the user command when the unique value of the vehicle is identical to the unique value of the remote control device, and when a comparison resultant value obtained when a timer difference value stored in the storage is compared with a difference value between the timer count value of the vehicle and a timer count value of the remote control device contained in the data is present in a pre-stored reference range.

2. The vehicle according to claim 1, wherein when the unique value of the vehicle is identical to the unique value of the remote control device and a comparison resultant value obtained when a timer difference value stored in the storage is compared with a difference value between the timer count value of the vehicle and the timer count value of the remote control device is present in the pre-stored reference range, the controller stores a difference value between the timer count value of the vehicle and the timer count value of the remote control device, as the timer difference value, in the storage.

3. The vehicle according to claim 1, wherein when the unique value of the vehicle is less than the unique value of the remote control device, the controller is configured to allow the unique value of the vehicle stored in the storage to be identical to the unique value of the remote control device.

4. The vehicle according to claim 3, wherein when the unique value of the vehicle is less than the unique value of the remote control device, the controller is configured to store a difference value between the timer count value of the vehicle and the timer count value of the remote control device, as the timer difference value, in the storage, and configured to approve the user command.

5. The vehicle according to claim 1, wherein the receiver is configured to receive the data over a radio frequency (RF) communication network.

6. The vehicle according to claim 1, wherein the receiver configured to receive data from a plurality of remote control devices;

the storage configured to store the unique value of the vehicle, the timer count value of the vehicle, and the timer difference value between the remote control device and the vehicle while being classified based on the respective remote control devices; and the controller configured to determine whether the user command for each remote control device is approved.

7. A remote control device comprising:

an input configured to receive a user command;

a timer configured to measure a time;

a transmitter configured to transmit data including the user command;

a storage configured to store a unique value of a remote control device, a first timer count value, a second timer count value, and a maximum value of the second timer count value; and a controller configured to increase the first timer count value and the second timer count value after lapse of a predetermined time, and stop operation of the timer after increasing the unique value of the remote control device when the second timer count value reaches the maximum value.

8. The remote control device according to claim 7, wherein upon receiving the user command, the controller is configured to operate the timer and control the transmitter to transmit the data.

9. The remote control device according to claim 7, wherein upon receiving the user command, the controller is configured to operate the timer, and control the transmitter to transmit data that include the first timer count value, the unique value of the remote control device, and the user command.

10. The remote control device according to claim 7, wherein upon receiving the user command, the controller is configured to change the second timer count value stored in the storage to an initial value.

11. The remote control device according to claim 7, wherein the transmitter is configured to transmit the data through a radio frequency (RF) communication network.

12. The remote control device according to claim 7, wherein when an abnormal situation occurs in the remote control device, the controller is configured to change the unique value of the remote control device stored in the storage to an initial value.

13. The remote control device according to claim 7, wherein the remote control device is a key fob.

14. A method for controlling a vehicle, comprising:

operating, by a controller, a timer;

increasing, by the controller, a timer count value of a vehicle after lapse of a predetermined time;

receiving, by a receiver, data from a remote control device;

comparing, by the controller, a unique value pre-stored in the vehicle with a remote control device's unique value contained in the data; and determining, by the controller, whether a user command contained in the data is approved based on a result of the comparison, wherein the determining whether the user command is approved includes:

approving the user command, when the unique value of the vehicle is identical to the unique value of the remote control device, and when a comparison resultant value obtained when a timer difference value pre-stored in the vehicle is compared with a difference value between the timer count value of the vehicle and a timer count value of the remote control device contained in the data is present in a pre-stored reference range.

15. The method according to claim 14, wherein the determining whether the user command is approved further includes:

when the unique value of the vehicle is identical to the unique value of the remote control device and a comparison resultant value obtained when a timer difference value pre-stored in the vehicle is compared with a difference value between the timer count value of the vehicle and the timer count value of the remote control device contained in the data is present in the pre-stored reference range, storing a difference value between the timer count value of the vehicle and the timer count value of the remote control device as the timer difference value.

16. The method according to claim 14, wherein the determining whether the user command is approved includes:

when the unique value of the vehicle is less than the unique value of the remote control device, controlling the unique value of the vehicle to be identical to the unique value of the remote control device.

17. The method according to claim 16, wherein the determining whether the user command is approved includes:

when the unique value of the vehicle is less than the unique value of the remote control device, storing a difference value between the timer count value of the vehicle and the timer count value of the remote control device as the timer difference value, and approving the user command.

18. The method according to claim 14, wherein the receiving the data includes receiving data over a radio frequency (RF) communication network.

19. The method according to claim 14, wherein the receiving the data includes receiving data from a plurality of remote control devices, and the determining whether the user command is approved is performed for each remote control device.

20. The method according to claim 14, wherein the approving the user command includes:

when a difference value between the timer count value of the vehicle and the timer count value of the remote control device contained in the data is equal to or less than a sum of the timer difference value pre-stored in the vehicle and a predetermined reference value, determining that a comparison resultant value is present in the pre-stored reference range.

* * * * *